US011682535B2

(12) United States Patent
Maragni et al.

(10) Patent No.: US 11,682,535 B2
(45) Date of Patent: Jun. 20, 2023

(54) ROCKER SWITCH

(71) Applicant: Essex Industries, Inc., St. Louis, MO (US)

(72) Inventors: Michael Maragni, Manchester, MO (US); Leane Darnold, Kirkwood, MO (US); Phil Hampton, St. Louis, MO (US)

(73) Assignee: Essex Industries, Inc., St. Louis, MO (US)

( * ) Notice: Subject to any disclaimer, the term of this patent is extended or adjusted under 35 U.S.C. 154(b) by 0 days.

(21) Appl. No.: 17/692,878

(22) Filed: Mar. 11, 2022

(65) Prior Publication Data

US 2022/0293363 A1 Sep. 15, 2022

Related U.S. Application Data

(60) Provisional application No. 63/160,303, filed on Mar. 12, 2021.

(51) Int. Cl.
*H01H 23/16* (2006.01)
*H01H 23/08* (2006.01)

(52) U.S. Cl.
CPC ..... *H01H 23/16* (2013.01); *H01H 23/08* (2013.01)

(58) Field of Classification Search
CPC .... H01H 23/143; H01H 23/30; H01H 23/025; H01H 2300/03; H01H 23/145; H01H 2221/016; H01H 23/14; H01H 23/04; H01H 23/168; H01H 2221/018; H01H 23/02; H01H 23/12; H01H 23/003; H01H 23/146; H01H 23/16; H01H 23/20; H01H 23/28; H01H 23/00; H01H 23/148; H01H 23/24; H01H 23/26
See application file for complete search history.

(56) References Cited

U.S. PATENT DOCUMENTS

| | | | |
|---|---|---|---|
| 3,828,148 | A | 8/1974 | Roeser |
| 3,957,230 | A | 5/1976 | Boucher et al. |
| 3,977,004 | A | 8/1976 | Bickel |
| 3,981,611 | A | 9/1976 | Jensen |
| 4,032,091 | A | 6/1977 | Reddy |
| 4,067,139 | A | 1/1978 | Pinkerton et al. |
| 4,079,902 | A | 3/1978 | Ryzhko et al. |
| 4,123,050 | A | 10/1978 | Casado |
| 4,140,352 | A | 2/1979 | Delpech et al. |
| 4,146,780 | A | 3/1979 | Sprey |
| 4,168,046 | A | 9/1979 | Hasquenoph et al. |
| 4,175,701 | A | 11/1979 | Wojciehowski et al. |
| 4,228,386 | A | 10/1980 | Griffith |

(Continued)

FOREIGN PATENT DOCUMENTS

| | | | |
|---|---|---|---|
| EP | 1283537 | A1 | 12/2003 |
| JP | 2004087290 | B2 | 3/2004 |
| KR | 20160087923 | A | 7/2016 |

*Primary Examiner* — Ahmed M Saeed
(74) *Attorney, Agent, or Firm* — Lewis Rice LLC

(57) ABSTRACT

A rocker switch that can include multiple redundancy at each position. Specifically, the rocker switch is a two-position rocker switch with both positions in line and with double or triple redundancy at each position. The rocker switch still provides a user with definitive snap "on" switching and the snap positions which can be used to activate multiple redundant internal circuit switches to provide for increased reliability of switch operation.

18 Claims, 9 Drawing Sheets

(56) References Cited

U.S. PATENT DOCUMENTS 4,233,652 A 11/1980 Oswald
4,275,858 A 6/1981 Bolton et al.
4,287,907 A 9/1981 Worthy
4,299,361 A 11/1981 Webb
4,326,189 A 4/1982 Crane
4,330,827 A 5/1982 Kettler
4,332,032 A 5/1982 Daniel
4,335,745 A 6/1982 Bouveret et al.
4,340,791 A 7/1982 Sorensen
4,347,901 A 9/1982 Wilhoit
4,351,394 A 9/1982 Enk
4,372,212 A 2/1983 Hoelzen et al.
4,413,322 A 11/1983 Foster et al.
4,472,780 A 9/1984 Chenoweth et al.
4,476,395 A 10/1984 Cronin
4,482,018 A 11/1984 Enk et al.
4,492,924 A 1/1985 Nilsson
4,502,691 A 3/1985 Ratliff et al.
4,531,081 A 7/1985 Liesegang
4,573,937 A 3/1986 Stanzel
4,616,793 A 10/1986 Hassler, Jr.
4,667,094 A 5/1987 Van-Hecke et al.
4,700,046 A 10/1987 Fristedt
4,735,380 A 4/1988 Barousse et al.
4,737,107 A 4/1988 Bories et al.
4,739,335 A 4/1988 Fourmaud et al.
4,762,294 A 9/1988 Carl
4,765,568 A 9/1988 Carl et al.
4,779,683 A 10/1988 Enk
4,814,579 A 3/1989 Mathis et al.
4,885,514 A 12/1989 Novis et al.
4,915,185 A 4/1990 Olson
4,936,389 A 6/1990 Macdonald et al.
4,968,946 A 11/1990 Maier
4,969,367 A 11/1990 Huber et al.
5,104,062 A 4/1992 Glaze
5,104,344 A 4/1992 Jancso, Jr.
5,129,826 A 7/1992 Munsch
5,165,625 A 11/1992 Gutman
5,222,166 A 6/1993 Weltha
5,261,778 A 11/1993 Zschoche
5,267,709 A 12/1993 Koharcheck et al.
5,367,901 A 11/1994 Petersen
5,381,987 A 1/1995 Carns
5,391,080 A 2/1995 Bernacki et al.
5,404,085 A 4/1995 Resch et al.
5,404,897 A 4/1995 Rozenblatt
5,479,162 A 12/1995 Barger et al.
5,512,917 A 4/1996 Scott
5,515,898 A 5/1996 Alcocer
5,621,400 A 4/1997 Corbi
5,627,744 A 5/1997 Baker et al.
5,642,022 A 6/1997 Sanz et al.
5,659,243 A 8/1997 Smith
5,709,103 A 1/1998 Williams
5,813,630 A 9/1998 Williams
5,824,978 A 10/1998 Karasik et al.
5,899,411 A 5/1999 Latos et al.
5,930,134 A 7/1999 Glennon
5,984,241 A 11/1999 Sparks
6,016,016 A 1/2000 Starke et al.
6,062,809 A 5/2000 Berkey et al.
6,134,875 A 10/2000 Massey
6,158,692 A 12/2000 Abild et al.
6,191,547 B1 2/2001 Fricke et al.
6,204,590 B1 3/2001 Audren et al.
6,210,036 B1 4/2001 Eberle et al.
6,224,442 B1 5/2001 Simpson et al.
6,246,564 B1 6/2001 Sugiura et al.
6,286,410 B1 9/2001 Leibolt
6,321,707 B1 11/2001 Dunn
6,325,328 B1 12/2001 Gabriel
6,327,994 B1 12/2001 Labrador
6,349,537 B1 2/2002 Newton
6,384,573 B1 5/2002 Dunn
6,439,512 B1 8/2002 Hart
6,453,678 B1 9/2002 Sundhar
6,480,091 B1 11/2002 Scott et al.
6,489,745 B1 12/2002 Koreis
6,497,389 B1 12/2002 Rawdon et al.
6,550,715 B1 4/2003 Reynolds et al.
6,572,974 B1 6/2003 Biscotte et al.
6,580,497 B1 6/2003 Asaka et al.
6,603,216 B2 8/2003 Costello
6,622,963 B1 9/2003 Ahrendt et al.
6,695,264 B2 2/2004 Schaeffer et al.
6,708,929 B1 3/2004 Gabriel
6,733,358 B1 5/2004 Wuest
6,779,758 B2 8/2004 Vu et al.
6,803,532 B1 10/2004 Lee
6,865,690 B2 3/2005 Kocin
6,880,466 B2 4/2005 Carman
6,894,625 B1 5/2005 Kozma et al.
6,914,201 B2 7/2005 Van Vooren et al.
6,929,222 B2 8/2005 Djuric
6,980,104 B2 12/2005 Pahl et al.
7,014,148 B2 3/2006 Dominguez
7,042,693 B2 5/2006 Sillence et al.
7,044,335 B2 5/2006 Aguirre et al.
7,219,023 B2 5/2007 Banke et al.
7,230,292 B2 6/2007 Graettinger
7,246,771 B2 7/2007 Wisch et al.
7,273,384 B1 9/2007 So
7,176,811 B1 12/2007 Parry
7,336,473 B2 2/2008 Gross
7,397,209 B2 7/2008 Hirai
7,469,862 B2 12/2008 Layland et al.
7,472,863 B2 1/2009 Pak
7,482,709 B2 1/2009 Berenger
7,513,458 B2 4/2009 Layland et al.
7,546,186 B2 6/2009 Yang
7,546,981 B2 6/2009 Hoffjann et al.
7,556,224 B2 7/2009 Johnson et al.
7,592,783 B1 9/2009 Jarvinen
7,598,625 B2 10/2009 Yu et al.
7,629,718 B2 12/2009 Gruendel et al.
7,651,052 B2 1/2010 Delort
7,677,529 B2 3/2010 Siska, Jr. et al.
7,688,084 B2 3/2010 Erdmann et al.
7,723,935 B2 5/2010 Kneller et al.
7,726,606 B2 6/2010 Graf et al.
7,823,967 B2 11/2010 Pamis et al.
7,825,830 B2 11/2010 Joyner
7,828,247 B2 11/2010 Greene
7,845,263 B1 12/2010 Miller
7,857,107 B2 12/2010 Yamamoto et al.
7,870,726 B2 1/2011 Matsui
7,875,993 B2 1/2011 Gudo
7,891,605 B2 2/2011 Nguyen et al.
7,901,115 B2 3/2011 Chien
7,942,370 B2 5/2011 Hillgren et al.
7,975,960 B2 7/2011 Cox et al.
7,994,939 B2 8/2011 Salvaudon
8,052,311 B2 11/2011 Khunga
8,083,392 B2 12/2011 Chien
8,089,415 B1 1/2012 West
8,096,499 B2 1/2012 Osswald et al.
8,104,129 B2 1/2012 Tang et al.
8,152,247 B2 4/2012 Colin
8,181,903 B2 5/2012 Posva
8,209,107 B2 6/2012 Rozman et al.
8,217,630 B2 7/2012 Markunas et al.
8,274,383 B2 9/2012 Mitchell et al.
8,287,326 B2 10/2012 Huang et al.
8,371,526 B2 2/2013 Shearer et al.
8,378,510 B2 2/2013 Tanaka et al.
8,390,972 B2 3/2013 Simper et al.
8,408,494 B2 4/2013 Garcia Rojo
8,417,995 B2 4/2013 Davy et al.
8,418,956 B2 4/2013 Fukui
8,436,485 B1 5/2013 Smith
8,547,675 B2 10/2013 Maier
8,567,762 B2 10/2013 Venturini et al.
8,581,155 B2 11/2013 Leary et al.

(56) References Cited

U.S. PATENT DOCUMENTS 8,600,584 B2 12/2013 Fervel et al.
8,604,741 B2 12/2013 Lebrun
8,612,067 B2 12/2013 Leon et al.
8,616,492 B2 12/2013 Oliver
8,753,122 B2 6/2014 Bohlender
8,757,542 B2 6/2014 Hopdjanian et al.
8,783,611 B2 7/2014 Peryea et al.
8,786,232 B2 7/2014 Chai et al.
8,787,031 B2 7/2014 Hania
8,829,737 B2 9/2014 Carrillo
8,830,888 B2 9/2014 Shin et al.
8,840,070 B2 9/2014 Boucaud et al.
8,843,660 B1 9/2014 Galibois et al.
8,868,808 B1 10/2014 Galibois et al.
8,886,370 B2 11/2014 Carlavan et al.
8,935,018 B2 1/2015 Hughes et al.
8,939,401 B2 1/2015 Pereira et al.
8,973,393 B2 3/2015 Atkey et al.
8,978,840 B2 3/2015 Lang et al.
8,981,265 B2 3/2015 Jial et al.
8,982,441 B2 3/2015 Schlam et al.
9,010,959 B2 4/2015 Edelson et al.
9,030,557 B2 5/2015 Wende et al.
9,033,273 B2 5/2015 Edelson et al.
9,064,646 B2 6/2015 Wavering
9,067,691 B2 6/2015 Pugh et al.
9,071,050 B2 6/2015 Kamihara et al.
9,081,372 B2 7/2015 Fervel et al.
9,106,125 B1 8/2015 Brandt et al.
9,121,487 B2 9/2015 De Mers et al.
9,166,400 B2 10/2015 Jiao et al.
9,242,728 B2 1/2016 Morrison
9,295,114 B2 3/2016 Trinschek et al.
9,302,636 B2 4/2016 Schult et al.
9,327,839 B2 5/2016 Giles et al.
9,335,366 B2 5/2016 Handy
9,379,642 B2 6/2016 Lagorce et al.
9,422,905 B2 8/2016 Anastasio et al.
9,428,271 B2 8/2016 Becks et al.
9,435,263 B2 9/2016 Chai et al.
9,435,264 B2 9/2016 Chai et al.
9,448,557 B2 9/2016 Maalioune
9,459,640 B2 10/2016 Courteille et al.
9,464,573 B2 10/2016 Remy et al.
9,469,410 B2 10/2016 Peake
9,469,415 B1 10/2016 Harvey
9,476,385 B2 10/2016 Moore et al.
9,477,629 B2 10/2016 Petillon
9,484,749 B2 11/2016 Brombach et al.
9,508,267 B2 11/2016 Galibois et al.
9,553,467 B2 1/2017 Yasui
9,611,049 B2 4/2017 Esteyne et al.
9,614,465 B2 4/2017 Shriver et al.
9,623,978 B2 4/2017 Anton et al.
9,630,707 B2 4/2017 Jaber et al.
9,637,210 B2 5/2017 Thomson
9,639,997 B2 5/2017 Chai et al.
9,643,729 B2 5/2017 Walter-Robinson
9,670,917 B2 6/2017 Nakajima et al.
9,676,475 B2 6/2017 Goldman et al.
9,701,414 B2 7/2017 Vaughan et al.
9,714,636 B2 7/2017 Newburg
9,718,390 B1 8/2017 Hadley et al.
9,729,096 B2 8/2017 Edwards
9,748,060 B2 8/2017 Knonowski et al.
9,764,822 B2 9/2017 Morrison
9,821,915 B2 11/2017 Giles et al.
9,849,849 B2 12/2017 Vieillard et al.
9,950,785 B2 4/2018 Onfroy et al.
9,960,597 B2 5/2018 Andrieu et al.
9,964,044 B2 5/2018 Juarez Becerril et al.
9,969,378 B2 5/2018 Howell et al.
9,981,738 B2 5/2018 Di Zazzo et al.
9,988,158 B2 6/2018 Lebrun et al.
10,063,047 B2 8/2018 Duarte et al.
10,082,360 B2 9/2018 Hartman et al.
10,114,783 B2 10/2018 Galibois et al.
10,119,495 B1 11/2018 Nestico et al.
10,150,433 B2 12/2018 Pal
10,168,072 B2 1/2019 Lucas et al.
10,189,574 B2 1/2019 Zhou et al.
10,207,839 B2 2/2019 Hearing et al.
10,208,620 B2 2/2019 Montoya et al.
10,218,251 B2 2/2019 Hartman et al.
10,220,949 B2 3/2019 Thomaschewski
10,230,574 B2 3/2019 Montrichard et al.
10,239,621 B2 3/2019 Hoch et al.
10,277,037 B2 4/2019 Brantl et al.
10,287,030 B2 5/2019 Lutze et al.
10,293,922 B2 5/2019 Cox et al.
10,295,457 B1 5/2019 Ocheltree
10,315,771 B1 6/2019 Rao et al.
10,323,906 B2 6/2019 Dejong
10,336,461 B2 7/2019 Mackin
10,343,767 B2 7/2019 McCormick et al.
10,358,980 B2 7/2019 Morioka et al.
10,364,032 B2 7/2019 Kammerer et al.
10,369,393 B2 8/2019 Wright
10,370,088 B2 8/2019 Morrison
10,374,416 B2 8/2019 Duarte et al.
10,383,434 B2 8/2019 Enzinger et al.
10,427,784 B2 10/2019 Parks
10,432,016 B2 10/2019 Brookfield
10,443,507 B2 10/2019 Schwarz et al.
10,450,056 B2 10/2019 Joseph et al.
10,457,413 B2 10/2019 Prakesh et al.
10,464,678 B2 11/2019 Brunaux et al.
10,494,117 B2 12/2019 Bosma
10,508,567 B2 12/2019 Stachowiak et al.
10,508,601 B2 12/2019 Sheridan et al.
10,509,304 B2 12/2019 Chien
10,513,481 B2 12/2019 Lepine et al.
10,543,749 B2 1/2020 Carailler et al.
10,574,131 B2 2/2020 Lutze
10,587,261 B2 3/2020 Kamiewicz et al.
10,598,047 B2 3/2020 Clauson et al.
10,604,240 B2 3/2020 Goyez et al.
10,608,565 B2 3/2020 Singh et al.
10,618,659 B2 4/2020 Boulet et al.
10,637,724 B2 4/2020 Johnson et al.
10,730,633 B2 8/2020 Anghel et al.
10,750,575 B2 8/2020 Rochell
10,759,536 B2 9/2020 Bajorat et al.
10,787,933 B2 9/2020 Clauson et al.
10,793,137 B2 10/2020 Boecke et al.
10,822,099 B2 11/2020 Barone et al.
10,826,409 B2 11/2020 Lacaux et al.
10,829,203 B2 11/2020 Huynh
10,840,040 B2 11/2020 Abdelli et al.
10,866,271 B2 12/2020 Pradier et al.
10,879,022 B1 * 12/2020 Levay ..... H01H 23/28
10,907,656 B2 2/2021 Newberry
10,913,530 B2 2/2021 Cox et al.
10,923,920 B2 2/2021 Loefflad
10,934,008 B2 3/2021 Vondrell et al.
10,964,221 B2 3/2021 Vana et al.
10,967,954 B2 4/2021 Nakagawa et al.
10,968,825 B2 4/2021 Mackin
10,979,509 B2 4/2021 Ma et al.
10,981,660 B2 4/2021 Mackin
10,981,665 B2 4/2021 Arany-Kovacs et al.
11,001,388 B1 5/2021 Parvizian et al.
11,015,480 B2 5/2021 Waun
11,027,824 B2 6/2021 Huynh
11,046,433 B2 6/2021 Trotter
11,053,019 B2 6/2021 Mackin
11,059,603 B2 7/2021 Trinschek
11,104,444 B2 8/2021 Knapp et al.
11,155,365 B2 10/2021 Soejima
11,159,102 B2 10/2021 Underhill et al.
11,174,012 B2 11/2021 Brunetti
11,174,040 B2 11/2021 Beck
11,196,585 B1 12/2021 Auerbach et al.
11,198,502 B2 12/2021 Huynh

(56) References Cited

U.S. PATENT DOCUMENTS

| | | | |
|---|---|---|---|
| 11,225,318 | B1 | 1/2022 | Seeley |
| 11,230,384 | B2 | 1/2022 | Lynn et al. |
| 11,235,861 | B2 | 2/2022 | Joseph et al. |
| 11,240,311 | B2 | 2/2022 | Binder et al. |
| 11,245,765 | B2 | 2/2022 | Binder et al. |
| 11,248,524 | B2 | 2/2022 | Djelassi |
| 11,260,988 | B2 | 3/2022 | Sure et al. |
| 11,267,574 | B2 | 3/2022 | Benson et al. |
| 11,274,484 | B2 | 3/2022 | Tendyra et al. |
| 11,319,054 | B2 | 5/2022 | Weder et al. |
| 11,336,511 | B2 | 5/2022 | Johnson et al. |
| 2005/0006214 | A1 | 1/2005 | Fujii |

* cited by examiner

ROCKER SWITCH

CROSS REFERENCE TO RELATED APPLICATIONS

This application claims benefit of U.S. Provisional Patent Application No. 63/160,303 filed Mar. 12, 2021, the entire disclosure of which is herein incorporated by reference.

BACKGROUND OF THE INVENTION

1. Field of the Invention

This disclosure is related to the field of switches and particularly rocker switches that can include multiple redundancy at each position.

2. Description of the Related Art

Switches, and particularly electrical switches, are currently ubiquitous in daily human life. Switches come in all shapes and sizes and from the simple to the complex. While they are near ubiquitous, different switches need to be built to handle particular tasks. A switch, as we tend to think of it, actually includes two "switching" elements. The first of these is the underlying electrical or circuit switch which is, in many respects, the true switch. This is typically very small and is the object that physically connects and disconnects the electrical or circuit path switched by the switch. It, thus, acts to open or close the circuit which carries out the functionality the switch is related to.

The second component of the switch is the interaction component or switch head. This is typically much larger and is designed to be manipulated by a human (or other) user. The head of the switch is what many people think of as a "switch" but technically is nothing other than a specialized lever, toggle or other piece configured to allow for convenient manipulation by human hands, which are typically quite large relative to the underlying electrical circuit switch, to control the action of switching the circuit.

It is in the creation of the interface between the switch head and the circuit switch where the differences in switches typically lie. As indicated, human hands (or any other body part we would want to use to activate a switch) are relatively large compared to electrical components which can be purposefully highly miniaturized. However, human hands are also highly manipulable within 3-Dimensional space with a very wide range of motion. Thus, macro scale switches are really devices to translate specific human motion acting on the head and switch into an expected electrical opening or closing circuit action which circuit action causes an electrical device to behave as the human intended by their act of manipulating the head in the particular fashion they did. Thus, items we think of as switches, such as a light switch, act to take a human motion (e.g. the pushing of a toggle head up or down or the depression of a particular part of a lever head) and translate that into circuit switching in the light circuit to create the desired action of turning the light on or off.

A lot of the purpose of a switch unit is, thus, to give a human user a clear way to manipulate the operation of the underlying circuit so it does what it is intended to do when the user instructs it to do so. The need for accurate translation of human movement into actual circuit switching can be convenient or essential depending on the purpose of the switch. As electrical objects pervade human existence currently, and we trust many of them with both our and others' lives, it is, thus, highly desirable to have switches that consistently and repeatedly switch circuits when the same human actions are performed.

One place where highly accurate switching is necessary is in the operation of complex machines, particularly when the operation of those machines is directly related to the maintenance or loss of human life. While there are large numbers of such applications, one is in the operation of transportation machines such as cars, trucks, boats, and aircraft.

Powered flight can easily be considered one of humankind's greatest accomplishments. The modern aircraft is an amazing piece of engineering and the skill requirements of a human pilot to keep it aloft are also impressive. Operation in three-dimensional space presents aircraft with a number of concerns that ground-based vehicles simply do not have and also tends to require a human operator to make many more choices in keeping the operation of the aircraft safe. In the first instance, humans, whether as operators or passengers in an aircraft, are not native to the skies. Aircraft have to deal with the fact that they are operating in an environment which typically does not allow for a safe stop to disembark human passengers or crew. A ground-based vehicle can typically be simply stopped if there are concerns in its operation, passengers and operators can disembark, and the vehicle can be safely inspected and repaired. Thus, in most cases, ground-based vehicles' major concern with failure of operation is safely coming to a stop and not in being able to get where they are going.

In an aircraft, there is typically no way to safely stop in midair. Instead, should an aircraft discover a midair concern, the aircraft still needs to have a place to land and safe landing typically requires sufficient aircraft operability, sufficient landing space, and sufficient pilot control for the aircraft to return to the surface of the earth in a controlled fashion and without hitting anything. An aircraft in midair is effectively only safe so long as it continues to operate correctly and safely. Midair operation, at least currently, is dependent on a human pilot's skills in piloting the aircraft being correctly translated by switches in the aircraft into aircraft actions and mechanical movement.

In order to keep aircraft operating correctly, its electrical systems are paramount as they control virtually everything and act to communicate a pilot's requested actions into aircraft actions. Because of this, many of their electrical systems require redundancy and this is true even down to items as simple as switches. A large number of aircraft systems are operated by switches of some form from simple toggle switches for turning components on and off to the complicated motions of a control stick which is translated by many switches into the direction that the pilot wishes to go. In order to improve safety within aircraft, many of these switches operate on double, triple, or even increased redundant circuit switches. This redundancy helps make sure that the action taken by the pilot with the macro switch they are interacting with is carried out by the underlying circuit since failure of a single circuit switch in the system will generally not cause the intent of the pilot to not be translated into switching within the circuit.

In addition to the need for redundancy in switches in aircraft for the purposes of safety, switches, particularly in aircraft, are often required to control many different things because of the sheer number of items that a pilot needs to control. When flying an aircraft, and particularly a rotorcraft, the pilot will often have both hands and both feet engaged with controls at all times. Thus, the need to activate additional controls that are needed during piloting typically requires that switches be located in easy reach and ideally on other controls.

To provide easy access to auxiliary controls while piloting, many of these controls (which can include everything from lighting controls, to controls over payloads, to controls for displays, to the operation of weapon systems on military aircraft) are located on the control sticks, grips, or wheels of aircraft that are held by the pilot while piloting. Auxiliary controls which are needed in flight are therefore often integrated into or attached to the controls where the hands are maintained during piloting operations. They are usually near or under where the hands are positioned during flight to allow for the switches to be operated without needing to remove the hand from the respective control and with a minimum of movement. In this way, the switches can be readily adjusted or operated by the user while maintaining full piloting control. This is not just used in aircraft, but in the operation of ground vehicles as well. One many people are familiar with, for example, is the inclusion of switches related to cruise control or sound system operation in a passenger car being located on the steering wheel so a user does not need to take their hands from the wheel to operate them.

While including switches on control sticks, grips, wheels, and the like is obviously highly beneficial, there is only a limited amount of space on these objects. Thus, there can only be a limited number of switches present along with the associated wiring and circuitry necessary for them to operate. While electrical components can be, and have, been successfully miniaturized over the years, it is often hard to shrink the human access component (the switch head) as humans are still relatively similar in size and have only so much control over fine motor movement.

As machines have become more and more complex, and it has become more and more desirable to include additional functionality at the user's fingertips, so to speak, switches have had to be able to provide for more individually detectable human actions in the same space, while also making sure that the human operator operates the switches with certainty. That is, the switch ideally provides feedback to the operator that the action the operator intends to engage is actually the one they are engaging. This latter element is often provided by switches having a visible or tactile indicator when they are in particular position and/or have moved from one position to another. For example, most switches "snap" where it is easier to hold them in a specific position than to move them between positions which gives them a snap or click as they move to position.

Even simple toggle or rocker switches sometimes have multiple positions (usually two) and it is desirable to have them have "snap" feel so the user is certain they have switched. Most of the time toggle or rocker switches move to distinct positions and then stay in them, but it can also be desirable to have rocker switches that can snap to position but will then snap back to the home or off position once the user lets up force on the rocker.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

There is described herein, among other things, a rocker switch that can include multiple redundancy at each position. Specifically, the rocker switch is a two-position rocker switch with both positions in line and with double or triple redundancy at each position.

Based on the above, there is also a need in the art to provide for rocker switches where a user has definitive snap to "on" switching and which can be used to activate multiple redundant internal circuit switches to provide for increased reliability of switch operation.

There is described herein, among other things, a rocker switch comprising: a switch head; a button support attached to the switch head and configured to rotate to a first detent position located on a first side of a center position and a second detent position located on a second side opposing the first side of the center position; a first lever arm with a first rotation point arranged on the second side; a second lever arm with a second rotation point arranged on the first side; a first circuit switch arranged so as to be switched when the first lever arm is rotated about the first rotation point; and a second circuit switch arranged so as to be switched when the second lever arm is rotated about the second rotation point; wherein moving the switch head in a first direction from a stable position causes: the button support to rotate from the center position to the first detent position; the button support to depress the first lever arm about the first rotation point; and the first lever arm to engage the first circuit switch; and wherein moving the switch head in a second direction opposing the first direction from the stable position causes: the button support to rotate from the center position to the second detent position; the button support to depress the second lever arm about the second rotation point; and the second lever arm to engage the second circuit switch.

In an embodiment, the rocker switch further comprises: a first snap feel mechanism, the first snap feel mechanism comprising: a first pin having a ball end, a base, and a center section therebetween; and a first ball bearing; wherein the first lever pushes the first pin against a first pin biasing mechanism; wherein, as the first lever pushes the first pin, the first ball bearing is pushed from being adjacent the center section of the first pin and against a first bearing biasing mechanism by the ball end of the first pin; and wherein the first ball bearing is adjacent the ball end of the first pin when the first lever engages the first circuit switch; and a second snap feel mechanism, the second snap feel mechanism comprising: a second pin having a ball end, a base, and a center section therebetween; and a second ball bearing; wherein the second lever pushes the second pin against a second pin biasing mechanism; wherein, as the second lever pushes the second pin, the second ball bearing is pushed from being adjacent the center section of the second pin and against a second bearing biasing mechanism by the ball end of the second pin; and wherein the second ball bearing is adjacent the ball end of the second pin when the second lever engages the second circuit switch.

In an embodiment of the rocker switch, the first circuit switch is one of a plurality of switches engaged by the first lever arm.

In an embodiment of the rocker switch, the plurality of switches engaged by the first lever arm includes two switches.

In an embodiment of the rocker switch, the plurality of switches engaged by the first lever arm includes three switches.

In an embodiment of the rocker switch, the switch head is generally a trapezoidal prism.

In an embodiment of the rocker switch, the switch head is generally a squircle.

In an embodiment of the rocker switch, the ball end is generally a sphere.

In an embodiment of the rocker switch, the ball end is generally a capsule.

In an embodiment of the rocker switch, the first snap feel mechanism will bias the button support to the center position.

In an embodiment of the rocker switch, the second snap feel mechanism will bias the button support to the center position.

There is also described herein, in an embodiment, a rocker switch comprising: a switch head; a button support attached to the switch head and configured to rotate to a detent position located on a first side of a center position; a lever arm with a rotation point arranged on a second side opposing the first side of the center position; and a circuit switch arranged so as to be switched when the lever arm is rotated about the rotation point; wherein moving the switch head in a first direction from a stable position causes: the button support to rotate from the center position to the detent position; the button support to depress the lever arm about the rotation point; and the lever arm to engage the circuit switch.

In an embodiment, the rocker switch further comprises: a snap feel mechanism, the snap feel mechanism comprising: a pin having a ball end, a base, and a center section therebetween; and a ball bearing; wherein the lever pushes the pin against a pin biasing mechanism; wherein, as the lever pushes the pin, the ball bearing is pushed from being adjacent the center section and against a bearing biasing mechanism by the ball end; and wherein the ball bearing is adjacent the ball end when the lever engages the circuit switch.

DETAILED DESCRIPTION OF THE PREFERRED EMBODIMENT(S)

The following detailed description and disclosure illustrates by way of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended that all matter contained in the description or shown in the accompanying drawings shall be interpreted as illustrative and not in a limiting sense.

Figure 1:
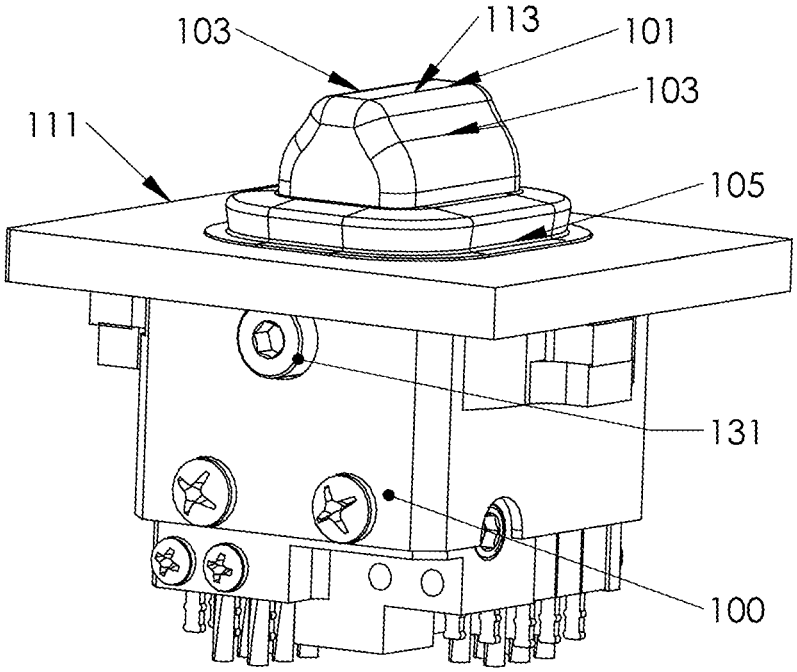
FIG. 1 depicts a left top perspective view of a first embodiment of a rocker switch.
Figure 2:
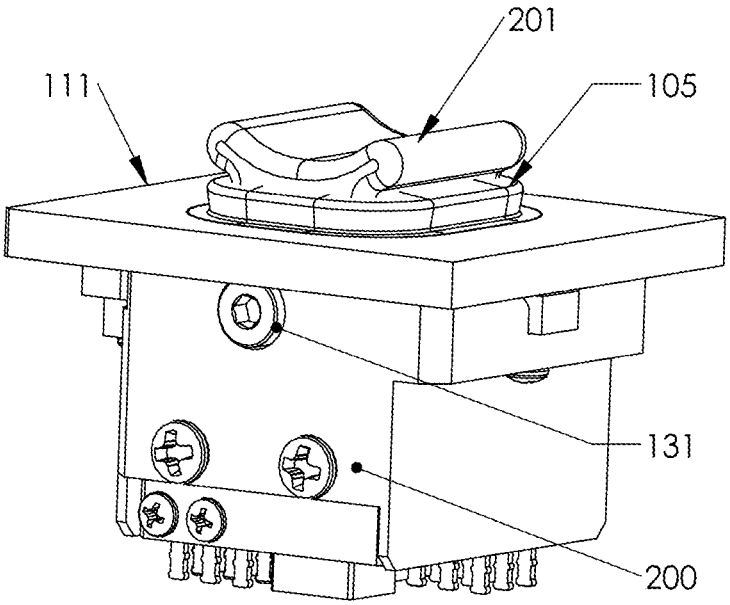
FIG. 2 depicts a left top perspective view of a second embodiment of a rocker switch.

FIGS. 1 and 2 show perspective views of two different embodiments (100) and (200) of rocker switches. The embodiments of FIGS. 1 and 2 are essentially the same in that each includes a switch head (101) or (201) which extends from a housing (111). However, the switch heads (101) and (201) are of different shape. The switch head (101) or (201) is the portion of the switch (100) or (200) that is intended to be human activated. As such, the switch head (101) or (201) may be any form of object which is designed to be pushed or pulled by a human.

In the depicted embodiment of FIG. 1, the switch head (101) comprises the general shape of a trapezoid or triangular prism which extends from the housing. In the depicted embodiment of FIG. 1, the trapezoid prism is generally in the form of a trapezium prism with rounded corners making both sides (103) of equal height. The sides (103) may include knurling or texturing to increase friction when contacted by a finger or thumb the pad of which would typically be placed against the side (103) and possibly over the top (113) to push or pull the head (101) generally perpendicular to its major axis (131). Alternatively, the head (101) can be moved by the side of a finger or thumb pushing against a side (103).

In the embodiment of FIG. 2, the switch head (101) comprises a generally square or "squircle" shape in cross section. The upper surface thereof is typically concave in at least one major dimension and may include knurling or texturing to increase friction when contacted by a finger or thumb the pad of which would typically be placed into the concave surface. In both the embodiments of FIGS. 1 and 2, the switch head (101) or (201) is surrounded by a cowl (105) which is designed to allow the head (101) to move relative to the housing (111) while still keeping objects (including dust and dirt) and moisture out of the housing (111).

Each position of the switch (100) or (200) can activate one, two, three, or more circuit switches simultaneously providing it with multiple redundancy of virtually any level. This type of switch (100) or (200) with double or triple redundancy is well suited for mounting in a grip or similar component of an aircraft for activation by a pilot with their thumb. However, it may be used in any application which calls for a rocker switch with two activation positions on either side of a center off position or any other application where three distinct positions are desired.

Figure 3:
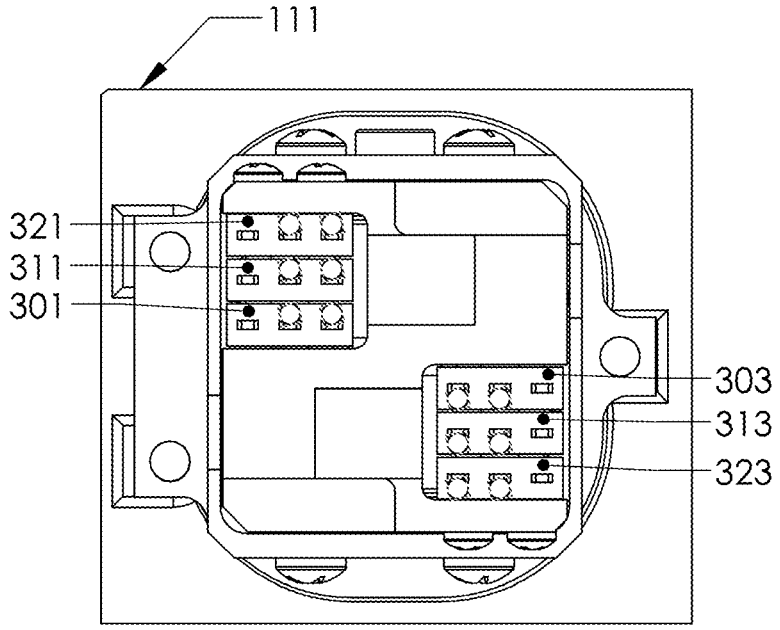
FIG. 3 depicts a bottom view of the rocker switch of FIG. 1.

As shown in FIG. 3, at the lower portion of the housing (111), and regardless of if it is switch (100) or (200), there are mounted a number of circuit switches (301), (303), (311), (313), (321), and (323). In the depicted embodiment, there are six such circuit switches (301), (303), (311), (313), (321), and (323) depicted. As this is a two-position switch, each "on" position will activate three of the circuit switches (301), (303), (311), (313), (321), and (323) compared to other positions which provides each position with triple redundancy. The circuit (301), (303), (311), (313), (321), and (323) are, thus, arranged in triplets with circuit switches (301), (311), and (321) being together and circuit switches (303), (313) and (323) being together. It should be apparent that each triplet of switches could be replaced by a single circuit switch, two circuit switches, or by four or more circuit switches if a different level of redundancy is desired. Each of the circuit switches (301), (303), (311), (313), (321), and (323) will generally comprise a micro or sub-micro button switch with a lever to assist with activation such as, but not limited to, the B1-5 lever series of switches or the B3 basic series of switches with auxiliary levers both of which are produced by Otto. This particular type of circuit switch is, however, by no means required and any sort of circuit switch activated by the motion of the switch (100) or (200) as discussed herein may be used.

For the sake of simplicity in the remaining discussion, the switch (100) embodiment of FIG. 1 will be used as an exemplary embodiment of the switch (100) or (200). However, it should be apparent that since the only difference between switch (100) and switch (200) is the shape of the head (101) or (201), the remaining discussion applies equally well to either embodiment even through switch (100) is discussed herein.

Figure 4:
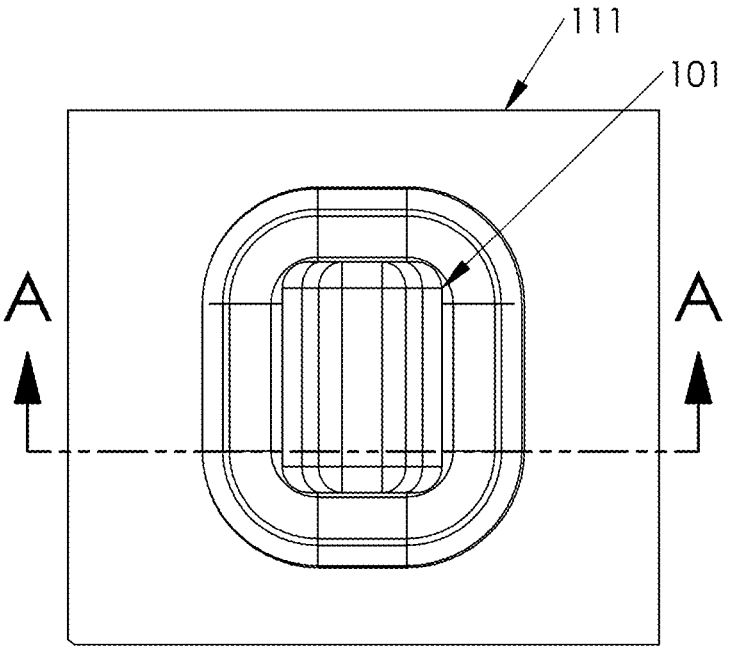
FIG. 4 depicts a top view of the rocker switch of FIG. 1 in the "off" position (home position).
Figure 5:
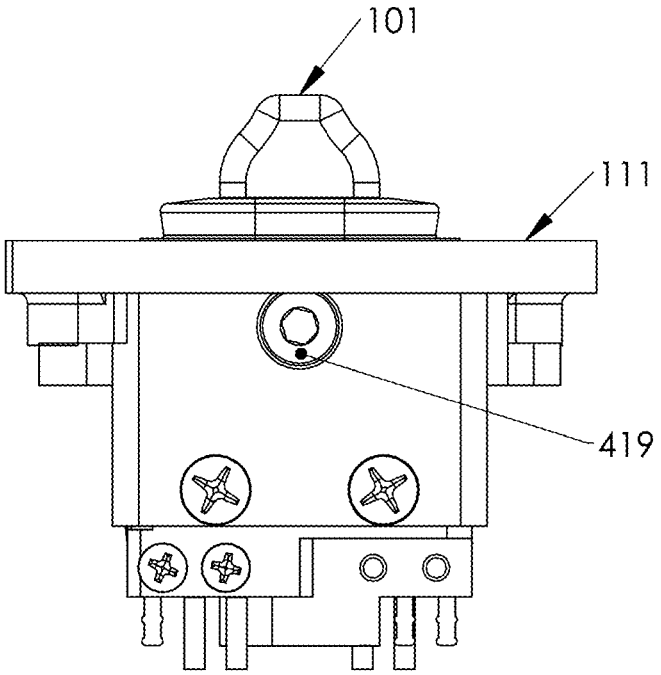
FIG. 5 depicts a side view of FIG. 4.
Figure 6:
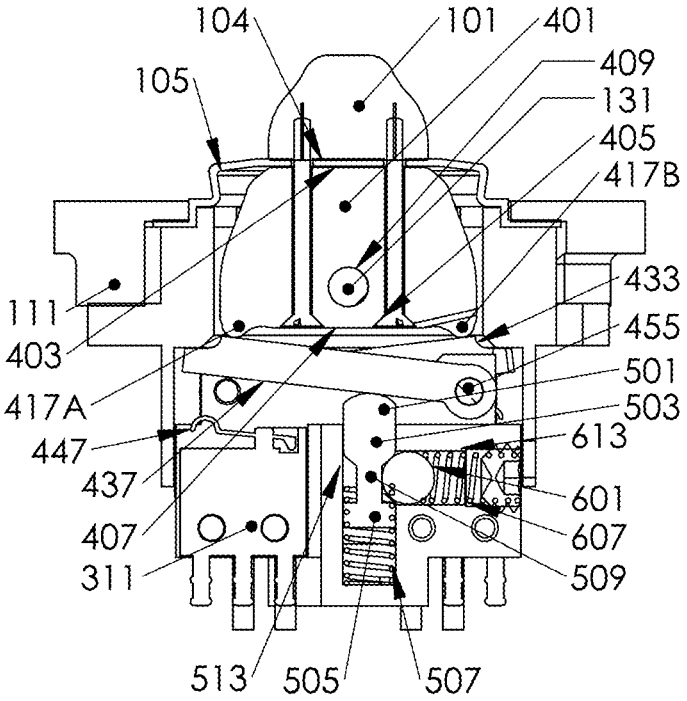
FIG. 6 depicts a cut-through along line A-A in FIG. 4.
Figure 7:
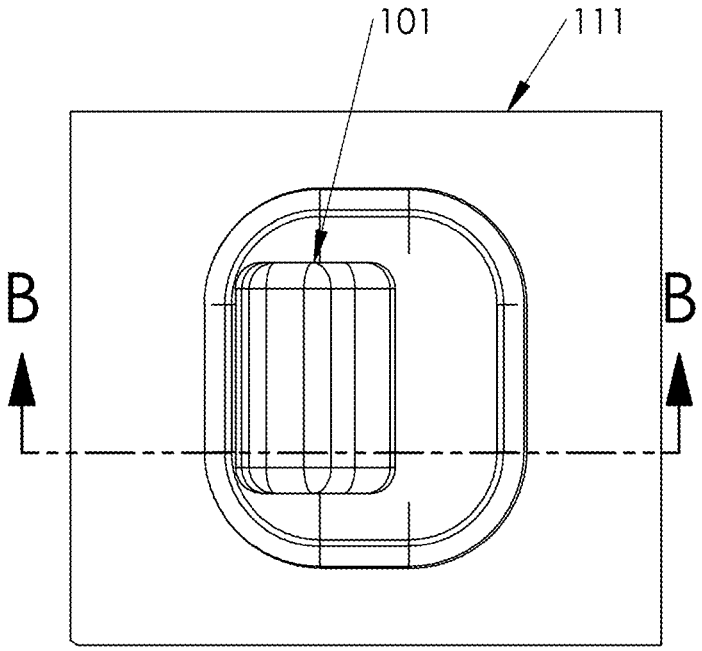
FIG. 7 depicts a top view of the rocker switch of FIG. 1 in the first on position.
Figure 8:
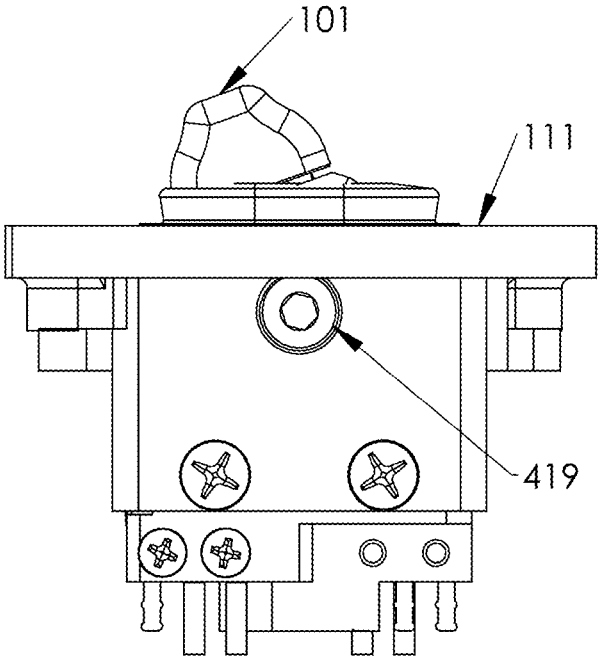
FIG. 8 depicts a side view of FIG. 7.
Figure 9:
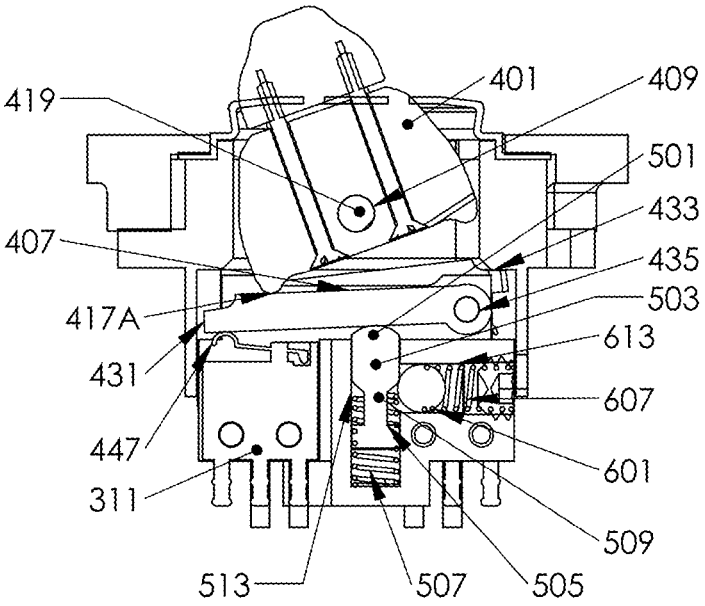
FIG. 9 depicts a cut-through along line B-B in FIG. 7.

The head (101) typically has three different linear positions into which it may be placed. In FIGS. 4, 5, and 6, the head (101) is shown in a center position, which, in this embodiment, is the off or home position. In FIGS. 7, 8, and 9 the head (101) is in a first detent position, which, in this embodiment, is also referred to as the forward position. The third positon or second detent position is a backward position. The use of the terms "forward" and "backward" here are arbitrary designators and are used solely to indicate that forward is on the opposing side of center to the backward position (which is not shown but is discussed below).

The switch (100) will now be discussed in conjunction with the various internal components. The structure of the internals of the switch (100) are best seen by Examining FIGS. 6 and 9 as each of these shows cut-through drawings of the switch (100) as indicated in the respective FIGS. 4 and 7. For ease of discussion and display, FIG. 6 and FIG. 9 are each depicted with only a subset of components labeled due to the large number of close components even though most of the components are visible in both FIGS.

The head (101) is attached to a button support (401). The button (401) is generally semi-circular in cross-section in at least one dimension with a flat upper surface (403) which interfaces with the bottom surface (104) of the head (101). This can make it appear as a portion of a flattened cylinder or sphere, for example. The button (401), depending on embodiment, may be attached to the head (101) in any fashion including, but not limited to, by screws (405), adhesives, or by being integrally molded with the head (101).

The lower surface (407) is generally flat, but includes two ridges or nubs (417A) and (417B). These nubs (417A) and (417B) are typically positioned toward at least two opposing outer corners of the lower surface (407) with one on either side of the major axis (131) of the head (101) or may run generally parallel to the major axis (131) of the head (101), again with one on each side. The nubs (417A) and (417B) are typically in the from of rounded bumps extending downward from the lower surface (407) of the button (401).

There is a hole (409) positioned in the button (401) typically at a point closer to the lower surface (407) than the upper surface (403). Through the hole (409) there is positioned a rod (419) which will also run generally parallel to the major axis (131) of the head (101). This allows for the button (401) to rotate about the rod (419).

Below the lower surface (407) there are positioned two lever arms (431) and (433). The lever arms (431) and (433) are positioned so as to run generally perpendicular to the major axis (131) of the head (101) and each will typically cross the major axis (131). As can be seen from the FIGS., the first lever arm (431), which is the one on the side of the switch (100) closest to the viewer, has its lower rotational connection (435) toward the right side (as viewed) of the switch (100) of FIG. 6. The second lever arm (433), which is spaced from the viewer into the page of FIG. 6, is partially visible behind the first lever arm (431) and is in opposing position with its rotation connection (not visible) on the left side of the head (101) of FIG. 6. It should be recognized that the terms "right" and "left" as used herein are not intended to denote any particular location relative to operation or other components. They are instead used simply to show that the components are in opposing positions relative to a central reference point, in this case the major axis (131).

Each of the lever arms (431) and (433) is positioned over a triplet of circuit switches (301), (311), (321), (303), (313), or (323). Specifically, lever arm (431) is positioned over switches (301) (311) and (321) and lever arm (433) is positioned over switches (303), (313), and (323). The lever arms (431) and (433) are sized and shaped so as to be over each circuit switch (301), (311), (321), (303), (313), or (323) in the associated triplet by effectively the same distance. As can be seen in FIG. 6, the lower surface (437) of the lever arm (431) is in contact with the integrated lever arm (447) of the circuit switch (311). Lever arm (431) is also in similar contact with the integrated lever arms of switches (301) and (321) even though they are not visible in FIG. 6. Similarly, the lever arm (433) is in an essentially mirrored position with the integrated lever arms of switches (303), (313) and (323).

Next to the triplet of switches (301), (311), and (321), there is positioned a snap-feel mechanism. The other side of the switch (100) (into the paper behind switch (301)), also has a similar snap-feel mechanism of essentially mirrored design. The snap-feel mechanism comprises a pin (503) which has a ball end (501). The ball end (501) in the depicted embodiment comprises an elongated cylinder with rounded ends generally in the form of a capsule or sphero-cylinder. In alternative embodiments, the ball end (501) may be generally spherical or may have other shapes. Typically, however, the ball end (501) will have angled or rounded ends so as to smoothly engage with the ball bearing (601) as discussed later.

The pin (503) may also comprise a widened base (505) which, in the depicted embodiment, is generally cylindrical with flat ends as opposed to the rounded or angled ends of the generally capsule or spherical ball end (501). This, however, gives the pin (503) a loose "dumbbell" shape where there is a narrowed center section (509), which is typically generally cylindrical, between the ball end (501) and the base (505). The pin (503) is placed within a shaft (513) through which it can slide. At the base (505) of the pin (503), there is a compression coil or wave spring (507) which serves to push the pin (503) toward the lever arm (431) and will normally place the ball end (501) into contact with the lower surface (437).

In FIG. 6, There is a ball bearing (601) which may, in an alternative embodiment, be the ball end of another pin, placed in a shaft (613) against another compression coil or wave spring (607). The shaft (613) is generally perpendicular to shaft (513) as shown in FIG. 6. The shaft (613) is also positioned so as to positon the ball bearing (601) in proximity to, and possibly in contact with, the center section (509) of the pin (503). In FIG. 6 the ball bearing (601), regardless of it being in contact with, or not with, the center section (509) is in contact with the ball end (501) generally on a surface more between the dumbbell sides of the pin (503) than any other as can be seen in the FIG.

FIGS. 7, 8, and 9 provide for the positon of the various components when the head (101) when the head (101) has been pushed to the forward position. The forward position typically will involve the head (101) rotating about the pin (419). In the depicted embodiment, the rotation is about 20 degrees from upright but that amount is by no means required and any amount may be used. As can be best seen in FIG. 9, when the head (101) is so rotated, it causes the button (401) to tip forward. This causes the surface (407) to rotate and pushes the nub (417A) into the lever arm (431) at a point spaced from that of the lever arm rotation (435). This causes the lever arm (431) to rotate downward and depress the integrated lever arm (447) which in turn activates the circuit switch (311). The motion of the lever arm (431) also generally simultaneously depresses the integrated lever arms on each of the other circuit switches (301) and (321) in the triplet resulting in all three circuit switches (301), (311), and (321) being activated generally simultaneously.

In addition to activating the circuit switches (301), (311), and (321), the lever arm (431) also pushes the ball end (501) of pin (503) into the shaft (513) against the biasing of spring (507). However, as should be apparent from FIG. 6, the ball bearing (601) is initially in the way of this and impedes the motion of the ball end (501) into the shaft (513). However, as the surfaces of the ball end (501) and ball bearing (601) are generally smooth and rounded (or may be simply angled in alternative embodiments), the force of the lever arm (431) on the ball end (501) will result in the ball end (501) pushing the ball bearing (601) into shaft (607) against spring (607).

Movement of the head (101) to this position is resisted by an amount of force typically proportional to the biasing forces of both spring (507) and/or spring (607) as well as the relative angle in the position of contact between ball head (501) and ball bearing (601) and their relative friction with each other. At some point along the travel of ball head (501) into shaft (513), the point of contact between the ball bearing (601) and ball head (501) alters so that the ball head (501) is no longer pushing ball bearing (601) downward (e.g. along shaft (513)). At this time, the ball head (501) can basically freely slide past ball bearing (601) continuing into shaft (513). In the depicted embodiment, the ball bearing (601) will typically slide or roll along the side of capsule shape of the ball head (501) at this stage.

At the point of clearance of the ball bearing (601), the lever (431) motion begun by the head (101) movement is no longer impeded by the forces of spring (607) or ball bearing (601) and is essentially solely impeded by the lever force of integrated lever (447) and spring (507) which is generally substantially less than the prior combination. Thus, the head (101) movement which was resisted by spring (507), spring (607), integrated lever arm (447), and friction between ball bearing (601) and ball head (501) is much less impeded as only spring (507) and integrated lever arm (447) impede the movement and the head (101) will feel like it "snaps" into position with the lever arm (431) fully depressed as shown in FIG. 9. At this point, the lever arm (431) can rotate no further as the circuit switches' (301), (311) and (321) housings are in the way.

When the user releases the switch head (101), the spring (507) will generally push the pin (503) upward (the reverse direction to the downward direction it was pushed by the user) and the spring (607) will push the ball bearing (601) back in the gap between the ball head (501) and the widened base (505). This motion (along with the spring force of integrated lever arm (447)) serves to push the lever arm (431) back to the position of FIG. 6. Once in the position of FIG. 6, the ball bearing (601) will also generally impede the pin (503) from continuing beyond the position in FIG. 6 as the widened base (505) not having a rounded surface against the ball bearing (601) hinders continued movement. Further, since FIG. 6 corresponds to the central position of the head (101), the snap mechanism interacting with lever arm (433) also impedes further motion.

It should be apparent that while FIGS. 7, 8, and 9 show the motion for the head (101) being moved in the forward direction, the head (101) can also be moved in the backward direction. To put this another way, if FIGS. 7, 8, and 9 show the head at a rotation of 20 degrees, the head (101) can also be rotated to −20 degrees to provide a different point of activation. This would operate in the same way as the motion of FIGS. 7, 8, and 9 (generally in mirror image) except that the lever arm (433) would depress the circuit switches (303), (313), and (323) instead of lever arm (431) depressing circuit switches (301), (311), and (321).

It should be noted that when the head (101) is tilted in the opposing direction to that which would cause the lever arm (431) or (433) to depress the relevant circuit switch triplet, the force of the spring (507) (or the corresponding element for lever arm (433)) could cause the lever arm (431) (or arm (433)) to tilt upward further than the position shown in FIG. 6. However, such arrangement is by no means required and further upward motion of lever arm (431) and/or lever arm (433) could be hindered. For example, this could be by having part of the lever arm (431) or lever arm (433) contact part of the housing (111) as shown in FIG. 6 for lever arm (431) and in FIG. 9 for lever arm (433).

While the invention has been disclosed in conjunction with a description of certain embodiments, the detailed description is intended to be illustrative and should not be understood to limit the scope of the present disclosure. As would be understood by one of ordinary skill in the art, embodiments other than those described in detail herein are encompassed by the disclosed invention. Modifications and variations of the described embodiments may be made without departing from the spirit and scope of the invention.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

Finally, the qualifier "generally," and similar qualifiers as used in the present case, would be understood by one of ordinary skill in the art to accommodate recognizable attempts to conform a device to the qualified term, which may nevertheless fall short of doing so. This is because terms such as "circular" are purely geometric constructs and no real-world component is truly "circular" in the geometric sense. Variations from geometric and mathematical descriptions are unavoidable due to, among other things, manufacturing tolerances resulting in shape variations, defects and imperfections, non-uniform thermal expansion, and natural wear. Moreover, there exists for every object a level of magnification at which geometric and mathematical descriptors fail due to the nature of matter. One of ordinary skill would thus understand the term "generally" and relationships contemplated herein regardless of the inclusion of such qualifiers to include a range of variations from the literal geometric meaning of the term in view of these and other considerations.

The invention claimed is:

1. A rocker switch comprising:

a switch head;

a button support attached to said switch head and configured to rotate to a first detent position located on a first side of a center position and a second detent position located on a second side opposing said first side of said center position;

a first lever arm with a first rotation point arranged on said second side;

a second lever arm with a second rotation point arranged on said first side;

a first circuit switch arranged so as to be switched when said first lever arm is rotated about said first rotation point;

a second circuit switch arranged so as to be switched when said second lever arm is rotated about said second rotation point;

a first snap feel mechanism, said first snap feel mechanism comprising:

a first pin having a ball end, a base, and a center section therebetween; and a first ball bearing;

wherein said first lever pushes said first pin against a first pin biasing mechanism;

wherein, as said first lever pushes said first pin, said first ball bearing is pushed from being adjacent said center section of said first pin and against a first bearing biasing mechanism by said ball end of said first pin; and wherein said first ball bearing is adjacent said ball end of said first pin when said first lever engages said first circuit switch; and a second snap feel mechanism, said second snap feel mechanism comprising:

a second pin having a ball end, a base, and a center section therebetween; and a second ball bearing;

wherein said second lever pushes said second pin against a second pin biasing mechanism;

wherein, as said second lever pushes said second pin, said second ball bearing is pushed from being adjacent said center section of said second pin and against a second bearing biasing mechanism by said ball end of said second pin; and wherein said second ball bearing is adjacent said ball end of said second pin when said second lever engages said second circuit switch;

wherein moving said switch head in a first direction from a stable position causes:

said button support to rotate from said center position to said first detent position;

said button support to depress said first lever arm about said first rotation point; and said first lever arm to engage said first circuit switch; and wherein moving said switch head in a second direction opposing said first direction from said stable position causes:

said button support to rotate from said center position to said second detent position;

said button support to depress said second lever arm about said second rotation point; and said second lever arm to engage said second circuit switch.

2. The rocker switch of claim 1, wherein said first snap feel mechanism will bias said button support to said center position.

3. The rocker switch of claim 1, wherein said second snap feel mechanism will bias said button support to said center position.

4. The rocker switch of claim 1, wherein said first circuit switch is one of a plurality of switches engaged by said first lever arm.

5. The rocker switch of claim 4, wherein said plurality of switches engaged by said first lever arm includes two switches.

6. The rocker switch of claim 4, wherein said plurality of switches engaged by said first lever arm includes three switches.

7. The rocker switch of claim 1, wherein said switch head is generally a trapezoidal prism.

8. The rocker switch of claim 1, wherein said switch head is generally a squircle.

9. The rocker switch of claim 1, wherein said ball end is generally a sphere.

10. The rocker switch of claim 1, wherein said ball end is generally a capsule.

11. A rocker switch comprising:

a switch head;

a button support attached to said switch head and configured to rotate to a detent position located on a first side of a center position;

a lever arm with a rotation point arranged on a second side opposing said first side of said center position;

a circuit switch arranged so as to be switched when said lever arm is rotated about said rotation point; and a snap feel mechanism, said snap feel mechanism comprising:

a pin having a ball end, a base, and a center section therebetween; and a ball bearing;

wherein said lever pushes said pin against a pin biasing mechanism; and wherein, as said lever pushes said pin, said ball bearing is pushed from being adjacent said center section and against a bearing biasing mechanism by said ball end;

wherein said ball bearing is adjacent said ball end when said lever engages said circuit switch; and wherein moving said switch head in a first direction from a stable position causes:

said button support to rotate from said center position to said detent position;

said button support to depress said lever arm about said rotation point; and said lever arm to engage said circuit switch.

12. The rocker switch of claim 11, wherein said first circuit switch is one of a plurality of switches engaged by said first lever arm.

13. The rocker switch of claim 12, wherein said plurality of switches engaged by said first lever arm includes two switches.

14. The rocker switch of claim 12, wherein said plurality of switches engaged by said first lever arm includes three switches.

15. The rocker switch of claim 11, wherein said switch head is generally a trapezoidal prism.

16. The rocker switch of claim 11, wherein said switch head is generally a squircle.

17. The rocker switch of claim 11, wherein said ball end is generally a sphere.

18. The rocker switch of claim 11, wherein said ball end is generally a capsule.

* * * * *